US005911365A

United States Patent [19]

Huang

[11] Patent Number: 5,911,365

[45] Date of Patent: Jun. 15, 1999

[54] SPRAY PAINT GUN

[75] Inventor: Hermit Y.C. Huang, Hsinchuang, Taiwan

[73] Assignee: Chia Chung Enterprises Co., LTD, Taipei Hsien, Taiwan

[21] Appl. No.: 08/798,550

[22] Filed: Feb. 11, 1997

[51] Int. Cl.[6] ..... B05B 1/30

[52] U.S. Cl. ..... 239/300

[58] Field of Search ..... 239/300, 301

[56] References Cited

U.S. PATENT DOCUMENTS

| | | | |
|---|---|---|---|
| 1,982,056 | 11/1934 | Jenkins | 239/301 |
| 2,082,060 | 6/1937 | Jenkins | 239/300 |
| 2,475,000 | 7/1949 | Beach, Jr. | 239/300 |
| 5,152,460 | 10/1992 | Barty | 239/300 X |

*Primary Examiner*—Lesley D. Morris

*Attorney, Agent, or Firm*—Bacon & Thomas, PLLC

[57] ABSTRACT

An improved spray paint gun, comprises a regulating port in the intersection between the inlet channel, main spray channel and side spray channel. The regulating port is provided with a regulating ring and the regulating is being provided with first, second and third apertures in the position corresponding to each of the inlet channel, the main opening and the side opening respectively. A regulating element is screwed onto the regulating port by a connecting element disposed at the regulating element. The connecting element is provided with a movable regulating rod which may insert into the regulating port. When the regulating rod moves downward to close the side spray channel completely, the thickness of the regulating port can be increased by the provision of the regulating ring to regulate the air stream pressure flows therethrough. Accordingly, the air stream pressure inside the main spray channel can meet the requirements of HVLP (high volume low pressure). Accordingly, the pressure is limited below 10 psi.

1 Claim, 7 Drawing Sheets

SPRAY PAINT GUN

FIELD OF THE INVENTION

The present invention relates to an improved spray paint gun wherein the paint gun is provided with a regulating port at one side. The regulating port is provided with an inlet port, a main spray channel and a side spray channel. The regulating port is provided with a stationary regulating ring which is provided with first, second and third apertures. Each of the apertures is corresponding to one of the inlet port, main spray channel and side spray channel. Furthermore, the regulating port is screwed with an adjusting element having a movable adjusting rod thereof. The inserting portion of the adjusting rod is provided with tapered and inclined surface. When the adjusting rod is moved downward, the adjusting rod may regulate the air stream which flows into the main spray channel by the gap generated between the regulating ring and the adjusting rod.

DESCRIPTION OF PRIOR ART

Referring to FIGS. 1 and 2, the conventional spray paint gun generally comprises a gun body 90 having an inlet channel 92 which passes through the handle 91. The gun body 90 is also provided with a main spray channel 93 and a side spray channel 94 which are connected to the inlet channel 92. An opening 95 is disposed at the gun body 90 in the position adjacent to the intersection between the inlet channel 92 and the main spray channel 93 and side spray channel 94. The opening 95 is provided with a fluid adjustment knob 96 which is interconnected with a bolt 97. In use, the bolt 97 is inserted and screwed into the opening 95 such that the one end of the bolt 97 is plugged to the corresponding port of the side spray channel 94 to regulate air stream which flows into the main spray channel 93 and the side spray channel 94. By this arrangement, the spraying pattern performed by the nozzle can be therefore adjusted.

Nevertheless, the bolt 97 is disposed within the knob 96 which is screwed into the opening 95. Accordingly, when the bolt 97 is moved downward and close to the side spray channel 94, the gap for air stream between the side spray channel 94 and the bolt 97 is reduced while the gap between the main spray channel 94 and the bolt 97 is not reduced as the side spray channel 96. In light of this, when the gap between the side spray channel 95 and the bolt 97 is completely closed, the gap between the main spray channel 94 and the bolt 97 is still completely opened. Meanwhile, since the air supply into the inlet channel 92 is unchanged, consequently, when the gap between the side spray channel 96 and the bolt 97 is completely closed, the air stream which flows into the main spray channel 95 is increased. As a result, the pressure inside the main spray channel 95 exceeds the regular value required by the EPA, i.e. 10 psi, because the high pressure will cause a large area of mist area which may cause environment pollution.

SUMMARY OF THE INVENTION

It is the object of this invention to provide an improved spray paint gun wherein the pressure within the main spray channel can be regulated within the requirement of HVLP, high volume low pressure, such that the mist pattern is controlled acceptable range.

In order to achieve the object set forth, an improved spray paint gun comprises a regulating port at one side. The regulating port is provided with an inlet port, a main spray channel and a side spray channel. The regulating port is provided with a stationary regulating ring which is provided with first, second and third apertures. The apertures correspond the inlet port, main spray channel and side spray channel respectively. Furthermore, an adjusting element having a movable adjusting rod is screwed into the regulating port. An inserting portion of the adjusting rod is provided with a tapered and inclined surface. When the adjusting rod is moved downward, the adjusting rod regulates the air stream which flows into the main spray channel by the gap generated between the regulating ring and the adjusting rod. Consequently, the air stream flowing into the main spray channel will not exceed the acceptable level and the mist pattern is controlled in an acceptable range.

BRIEF DESCRIPTION OF DRAWINGS

In order that the present invention may more readily be understood the following description is given, merely by way of example with reference to the accompanying drawings, in which.

Brief Description of Numerals

Figure 1:
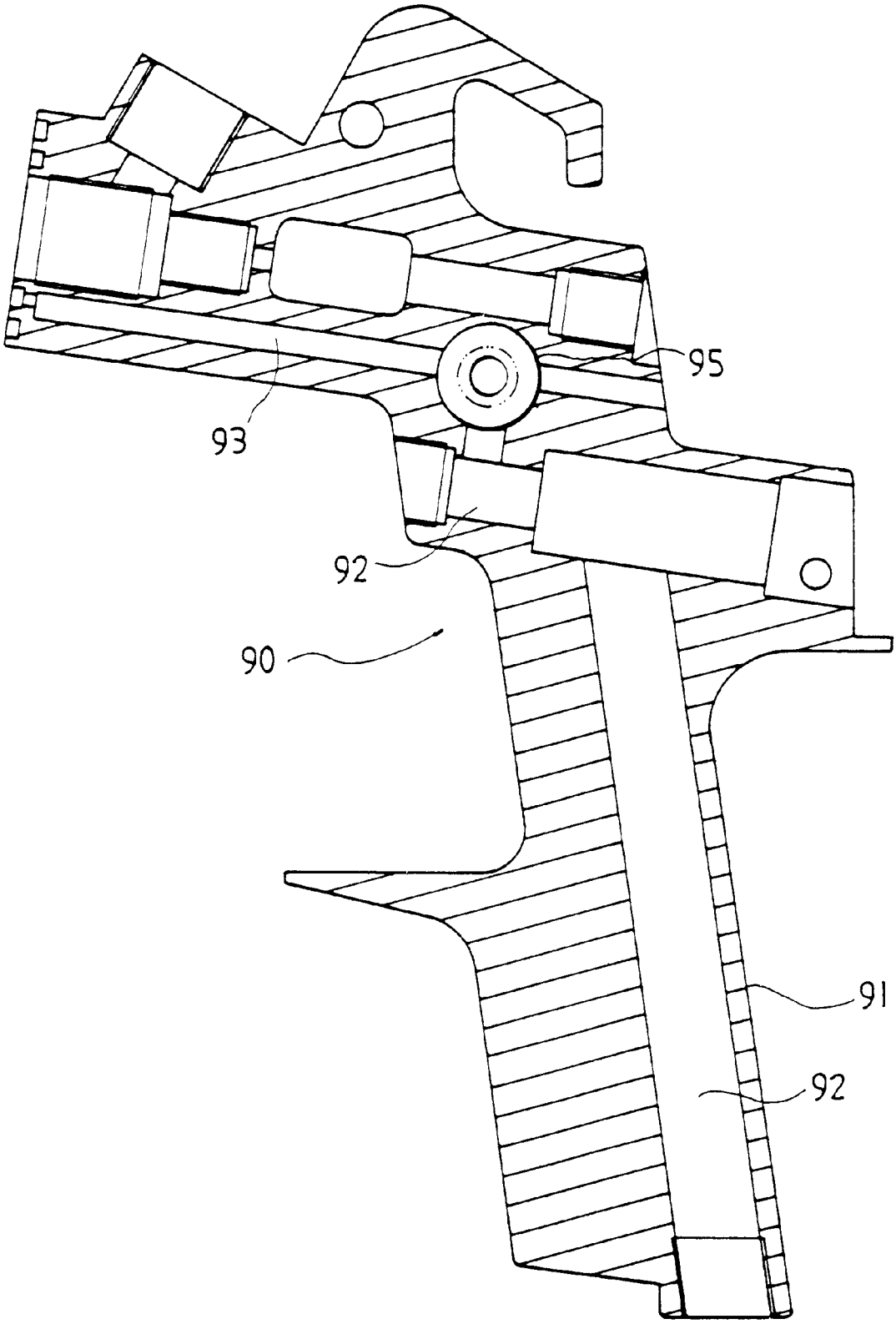
FiG 1 PRIOR ART
FIG. 1 is a side cross sectional view of a conventional spray paint gun.
Figure 2:
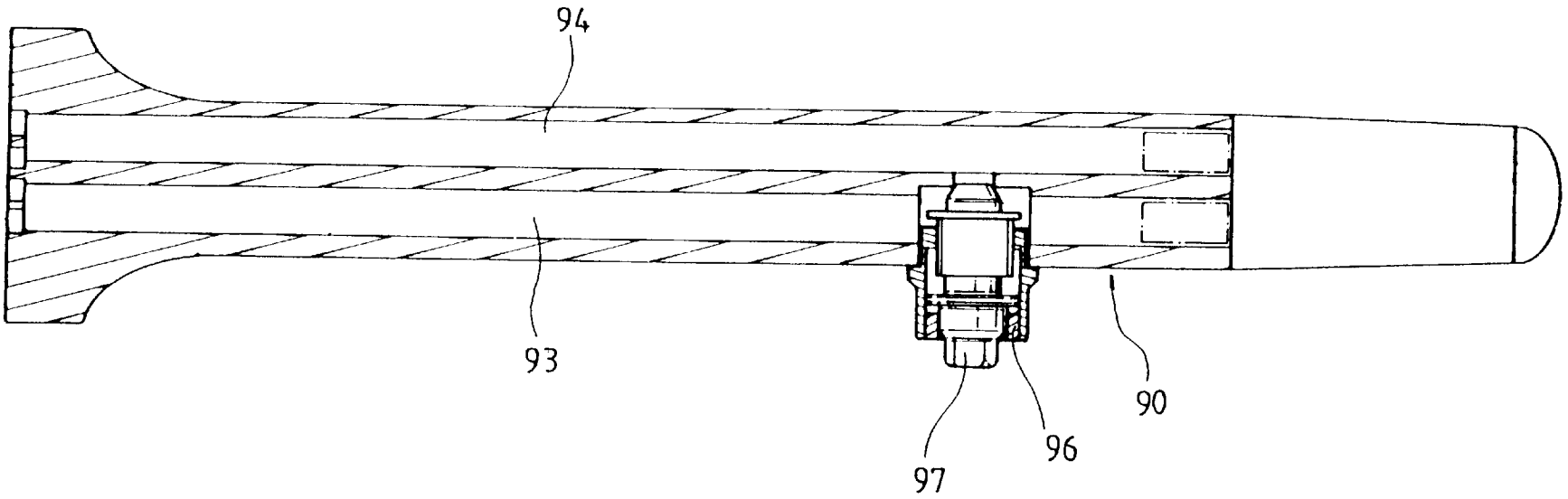
FIG 2 PRIOR ART
FIG. 2 is a top cross sectional view of a conventional spray paint gun.
Figure 3:
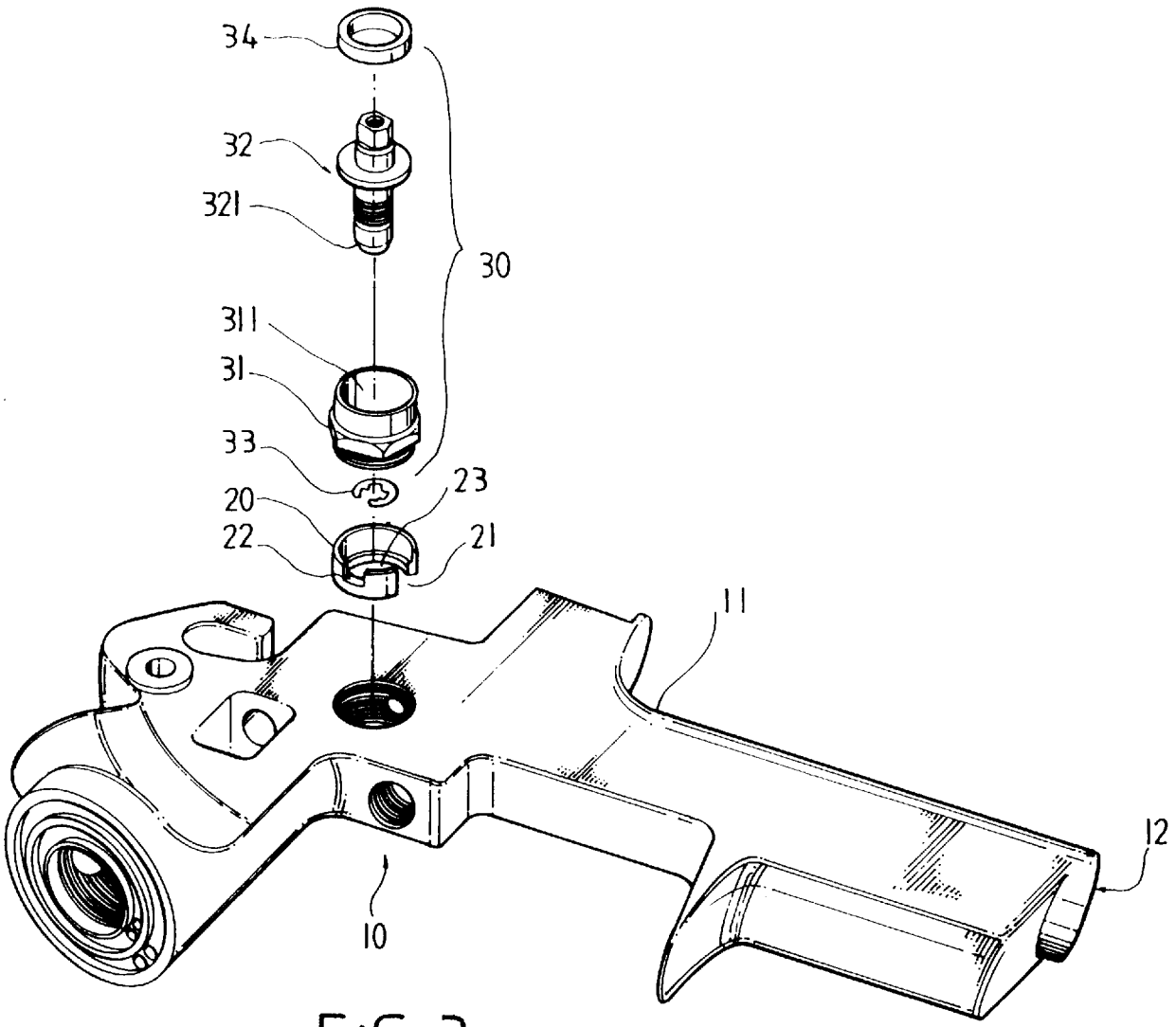
FIG. 3 is an exploded perspective view of the spray paint gun made according to this invention.
Figure 4:
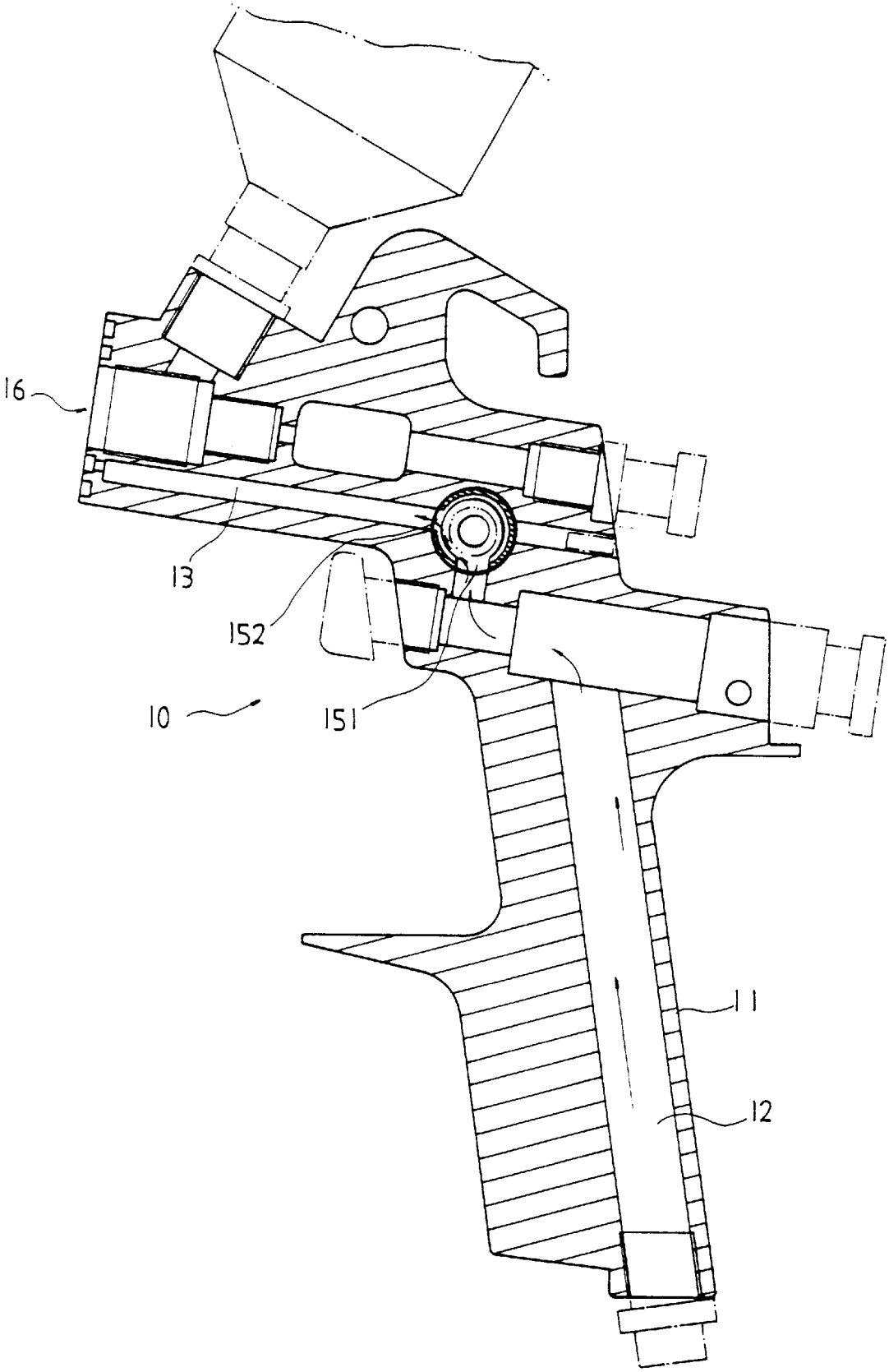
FIG. 4 is a front cross sectional view of the spray paint gun made according to this invention.

| | | | |
|---|---|---|---|
| 10 | gun body | 20 | regulating ring |
| 30 | regulating element | 31 | connecting element |
| 32 | adjusting rod | | |

DETAILED DESCRIPTION OF PREFERRED EMBODIMENT

Referring to FIGS. 3, 4, 5 and 6, the improved spray paint gun 10 made according to this invention comprises a gun body. The spray paint gun 10 is provided with an inlet channel 12 which passes through the handle 11. The spray paint gun 10 is also provided with a main spray channel 13 and side spray channel 14 on horizontal and vertical directions respectively. A regulating port 15 is disposed in the intersection between the inlet channel 12, main spray channel 13 and the side spray channel 14. The peripheral of the regulating port 15 is provided with an inlet opening 151, main spray channel opening 152 and side spray channel opening 153. Each of the openings is in fluid communication with inlet channel 12, main spray channel 13 and the side spray channel 14.

A stationary regulating ring 20 is disposed within the regulating port 15 of the spray paint gun 10. The regulating ring 20 is also provided with first, second and third apertures 21, 22, and 23 corresponding respectively to the inlet opening 151, main spray channel opening 152 and side spray channel opening 153.

A regulating element 30 is screwed into the regulating port 15. The regulating element 30 includes a connecting element 31 to be attached to the regulating port 15. In the preferred embodiment, it is a nut. Of course other suitable connecting element pertinent to the skilled in the art can also be applied. The connecting element 31 is provided with a through hole 311 having inner threaded portion thereof. A regulating rod 32 having another threaded portion is movably disposed within the through hole 311. One end of the regulating rod 32 is provided with a cone-shape inclined surface 321. The inclined surface 321 is enveloped with a fixing element 33, i.e. a C-ring. Of course other suitable connecting element pertinent to the skilled in the art can also be applied. Accordingly, when the regulating rod 32 is rotated, with the provision of the fixing element 33, the regulating rod 32 will not be removed from the connecting element 31. Furthermore, another end of the regulating rod 32 is enveloped with an enveloping ring 34.

Referring to FIGS. 4, 5, 6 and 7, when the air stream is supplied from a compressor (not shown) to the inlet channel 12 of the spray gun 10, the air stream firstly flows into the regulating ring 20 within the regulating port 15 through the inlet opening 151 via the inlet channel 12. Then the air stream flows into the main spray channel 13 and the side spray channel 14 via the second aperture 22 and third aperture 23 of the regulating ring 20 and the main opening 152 and side opening 153 of the regulating port 15. Afterward, the air stream is directed to the nozzle (not shown) disposed at one end of the gun head 16.

Figure 5:
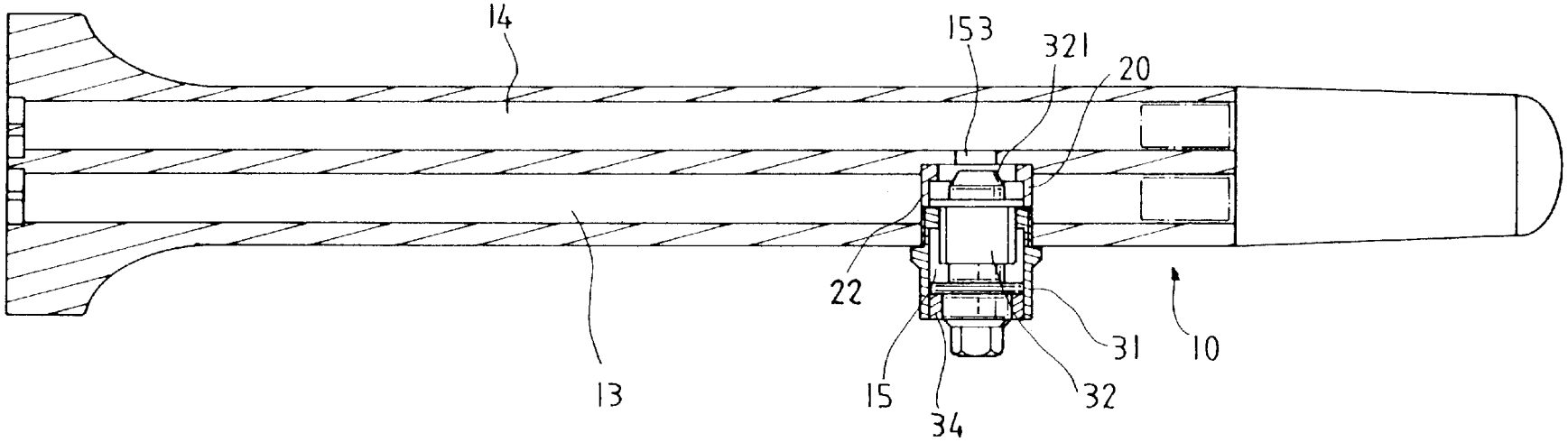
FIG. 5 is a top cross sectional view showing the movement thereof.

Accordingly, when the cone-shape inclined surface 321 of the regulating rod 32 which is disposed within the regulating port 15 is moved inward, the gap within the regulating port 15 is reduced. Accordingly, the air stream flowing into the a regulating port 15 is also reduced, consequently, the air stream which flows into the main spray channel 13 and side spray channel 14 is also reduced. As a result, the inlet cross section of the main spray channel 13 is also reduced and the cross section will reduce to the lowest level when the side spray channel 14 is completely closed, as shown in FIGS. 5, 6 and 7.

Figure 6:
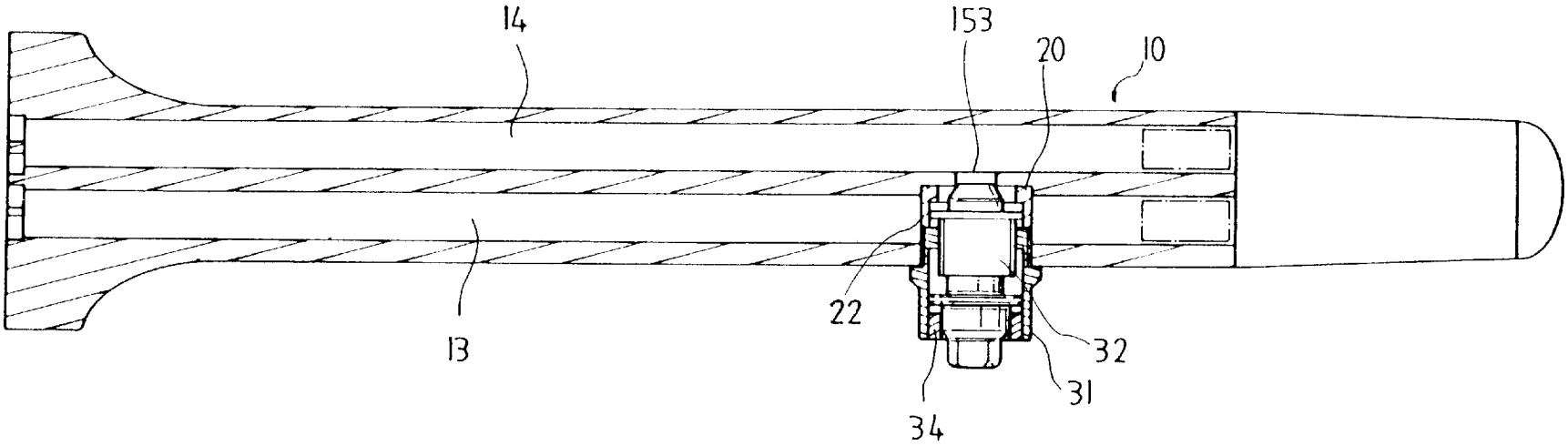
FIG. 6 is still a top cross sectional view showing the movement thereof.
Figure 7:
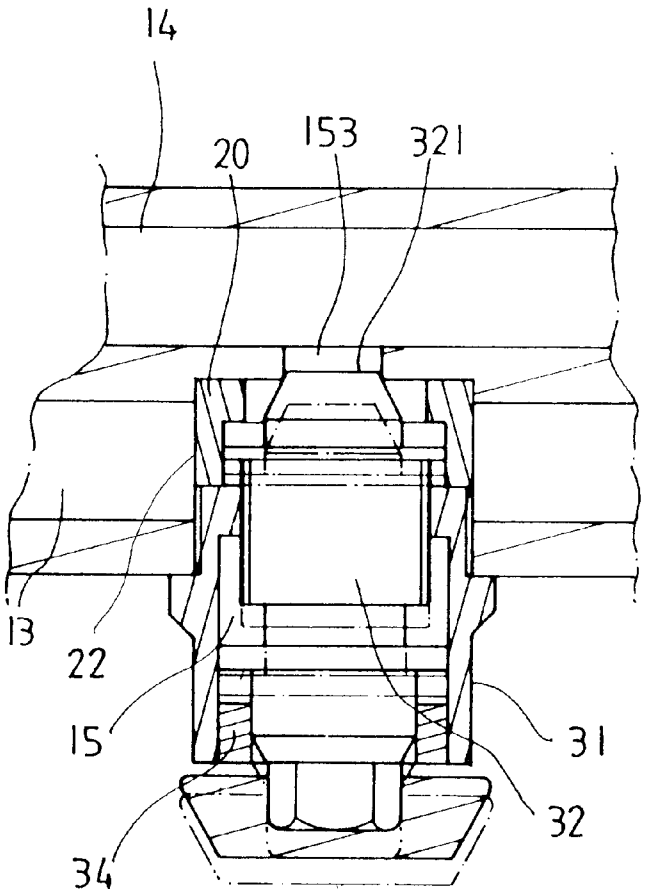
FIG. 7 is a schematic illustration showing the relative movement between the adjusting rod and the regulating ring.

When the cone-shape inclined surface 321 of the regulating rod 32 is plugged within the side opening 153 of the regulating port 15, as shown in FIGS. 6 and 7. The gap between the regulating port 15 and the regulating rod 32 can be reduced by attaching a stationary regulating ring 20 to narrow the opening of the regulating port 15. Accordingly, the air stream will flow into the main opening 152 as directed by the flow between the regulating rod 32 and the regulating ring 20. Since the gap between the regulating ring 20 and the regulating rod 32 is comparatively smaller than the gap between the opening 95 and the bolt 97 of the spray gun 90, consequently, the air stream flowing in is also smaller then the conventional spray gun 90. As a result, the flow speed is faster then the conventional one. From the Bernoulli's equation, $P_1V_1=P_2V_2$, the air stream pressure inside the main spray inlet is smaller than the main spray channel 93 of the spray gun 90. As a result, the air stream flowing into the main spray channel 13 can achieve and meet the requirements of High Volume Low Pressure, i.e. the pressure within the main spray channel 13 will not exceed the required range such that the mist pattern will not cause an environment pollution.

While particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

I claim:

1. An improved spray paint gun, comprising:

a gun body provided with a regulating port at an intersection between an inlet channel, a main spray channel and a side spray channel, said regulating port being provided with an inlet opening, a main opening and a side opening at a periphery thereof which are in fluid communication with said inlet channel, said main spray channel and said side spray channel, respectively;

a stationary regulating ring disposed within said regulating portion to increase the thickness of said regulating port, said regulating ring being provided with first, second and third apertures in a position corresponding to said inlet opening, said main opening and said side opening, respectively; and a regulating element screwed into said regulating port by a connecting element disposed on said regulating element, said connecting element being provided with a movable regulating rod which is insertable into said regulating port to regulate an air stream which flows into said main spray channel by a gap created between said regulating ring and said regulating rod.

* * * * *